US009651907B1

(12) United States Patent
Aoki et al.

(10) Patent No.: US 9,651,907 B1
(45) Date of Patent: May 16, 2017

(54) IMAGE FORMING APPARATUS, DENSITY ADJUSTING DEVICE, NON-TRANSITORY COMPUTER READABLE MEDIUM, DENSITY ADJUSTING METHOD, AND IMAGE FORMING METHOD

(71) Applicant: FUJI XEROX CO., LTD., Tokyo (JP)

(72) Inventors: Matsuyuki Aoki, Kanagawa (JP); Hiroaki Kumai, Kanagawa (JP); Makoto Hamatsu, Kanagawa (JP); Shoji Yamauchi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/217,308

(22) Filed: Jul. 22, 2016

(30) Foreign Application Priority Data

Feb. 17, 2016 (JP) ..... 2016-027846

(51) Int. Cl.
*G03G 15/00* (2006.01)
*G03G 15/16* (2006.01)

(52) U.S. Cl.
CPC ..... *G03G 15/5025* (2013.01); *G03G 15/16* (2013.01)

(58) Field of Classification Search
CPC ..... G03G 15/5025; G03G 15/16
See application file for complete search history.

(56) References Cited

U.S. PATENT DOCUMENTS 7,324,769 B2 * 1/2008 Yamaoka ..... G03G 15/0121 399/49
7,773,896 B2 * 8/2010 Yagawara ..... G03G 15/5058 399/46
8,165,481 B2 * 4/2012 Iimura ..... G03G 15/0131 399/27

FOREIGN PATENT DOCUMENTS

JP 5006673 B2 8/2012

* cited by examiner

*Primary Examiner* — Gregory H Curran
(74) *Attorney, Agent, or Firm* — Sughrue Mion, PLLC

(57) ABSTRACT

An image forming apparatus includes a density adjusting unit that executes first formation of forming a first color sample in a transfer area on an image carrier, first adjustment of adjusting output characteristics of an image forming unit to reduce a difference between a measured density of the first color sample and a first target density, second formation of forming a second color sample in a non-transfer area on the image carrier, second adjustment of adjusting the output characteristics to reduce a difference between a measured density of the second color sample and a second target density, and third adjustment of adjusting the output characteristics to reduce a difference in output density between the transfer and non-transfer areas, if the difference between the measured density of the second color sample and the second target density exceeds a predetermined extent after repeating the second formation and the second adjustment.

10 Claims, 11 Drawing Sheets

IMAGE FORMING APPARATUS, DENSITY ADJUSTING DEVICE, NON-TRANSITORY COMPUTER READABLE MEDIUM, DENSITY ADJUSTING METHOD, AND IMAGE FORMING METHOD

CROSS-REFERENCE TO RELATED APPLICATIONS

This application is based on and claims priority under 35 USC 119 from Japanese Patent Application No. 2016-027846 filed Feb. 17, 2016.

BACKGROUND

The present invention relates to an image forming apparatus, a density adjusting device, a non-transitory computer readable medium, a density adjusting method, and an image forming method.

SUMMARY

According to an aspect of the invention, there is provided an image forming apparatus including an image carrier, an image forming unit, a transfer unit, a density measuring unit, and a density adjusting unit. The image carrier carries an image formed on a surface thereof. The image forming unit forms the image on the image carrier. The transfer unit transfers the image on the image carrier onto a recording medium. The density measuring unit measures a density of the image on the image carrier. The density adjusting unit adjusts an output density of the image forming unit. The density adjusting unit further executes first formation control, first adjustment, second formation control, second adjustment, and third adjustment. The first formation control forms a first color sample in a transfer area of an area on the image carrier, in which the carried image is transferred onto the recording medium. The first adjustment adjusts output characteristics of the image forming unit to reduce a difference between a measured density of the first color sample measured by the density measuring unit and a predetermined first target density. The second formation control forms a second color sample in a non-transfer area of the area on the image carrier excluding the transfer area. The second adjustment adjusts the output characteristics of the image forming unit to reduce a difference between a measured density of the second color sample measured by the density measuring unit and a predetermined second target density. The third adjustment adjusts the output characteristics of the image forming unit to reduce a difference in the output density between the transfer area and the non-transfer area, if the difference between the measured density of the second color sample and the second target density exceeds a predetermined extent as a result of repeating the second formation control and the second adjustment.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Figure 1:
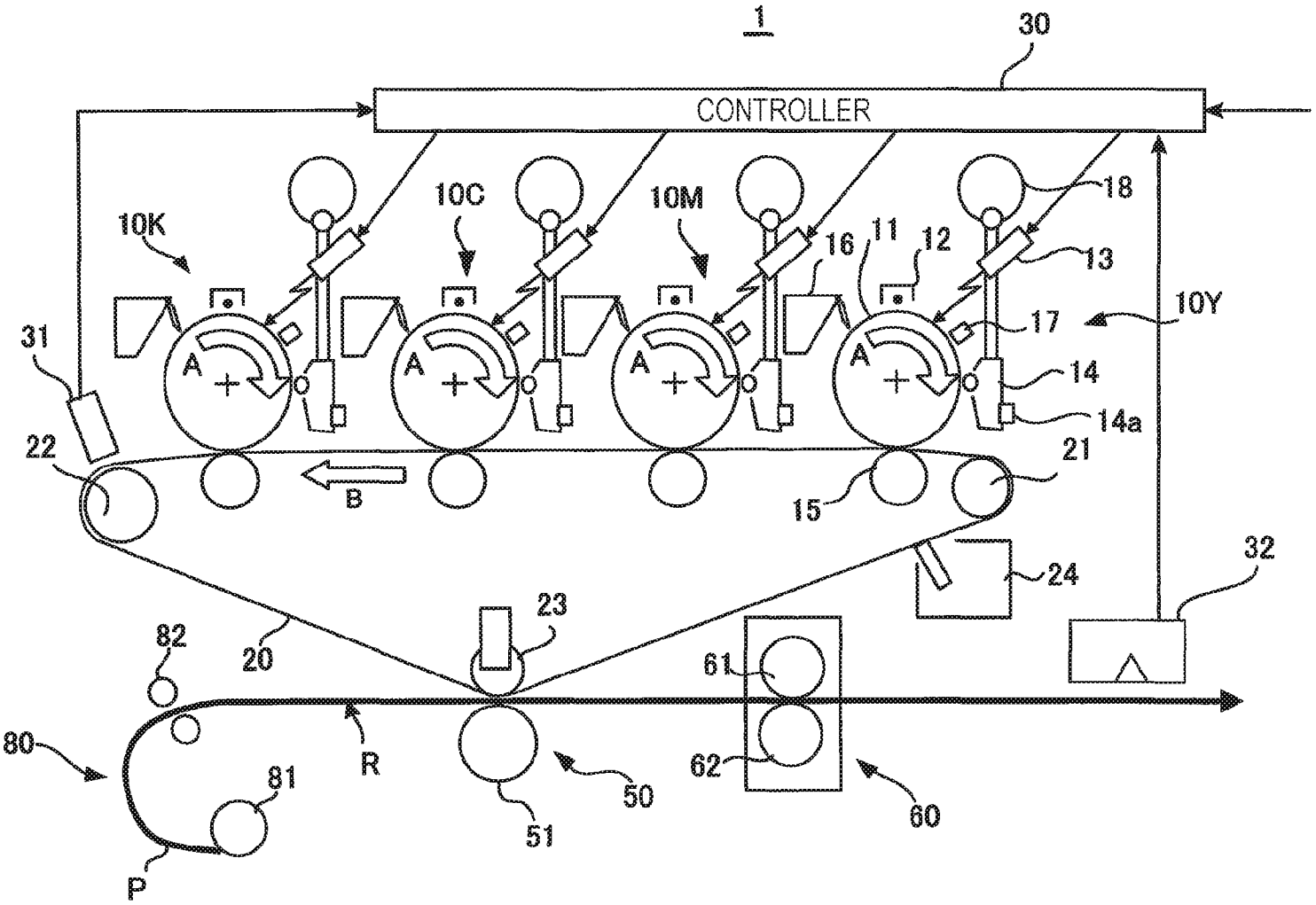
FIG. 1 is a schematic configuration diagram of a printer corresponding to a specific exemplary embodiment of an image forming apparatus.

FIG. 1 is a schematic configuration diagram of a printer corresponding to a specific exemplary embodiment of an image forming apparatus.

The printer 1 includes plural (four in the exemplary embodiment) image forming units 10 (specifically, 10Y (yellow), 10M (magenta), 10C (cyan), and 10K (black)) in which respective color component toner images are formed with an electrophotographic system, for example. The printer 1 also includes an intermediate transfer belt 20 onto which the color component toner images formed in the image forming units 10 are sequentially transferred (first-transferred) to be carried thereon. The printer 1 further includes a second transfer device 50 that batch-transfers (second-transfers) the toner images transferred to the intermediate transfer belt 20 onto a sheet P. Furthermore, the printer 1 includes a fixing device 60 that fixes the second-transferred toner images on the sheet P and a controller 30 that controls respective mechanical units of the printer 1.

The image forming units 10 (10Y, 10M, 10C, and 10K) have the same configuration except for the color of toner used therein. Therefore, a description will be made with the image forming unit 10Y for yellow taken as an example. Each of the image forming units 10 includes a photoconductor drum 11 that rotates in the direction of arrow A, and a charger 12, an exposure device 13, potential sensors 17, a developing device 14, a first transfer roller 15, and a drum cleaner 16 are disposed around the photoconductor drum 11.

The charger 12 charges the photoconductor drum 11 to a predetermined potential, and the exposure device 13 exposes the charged photoconductor drum 11 to thereby write an electrostatic latent image on a surface of the photoconductor drum 11. Although the exemplary embodiment adopts a non-contact corona discharger as the charger 12, a contact-type charging roller may also be adopted. Further, although the exemplary embodiment adopts, as the exposure device 13, a system that scans the surface of the photoconductor drum 11 with laser light, a system may also be adopted which performs exposure with a light emitting diode (LED) array having LED elements arranged in a line, for example.

The potential sensors 17 measure the potential of the electrostatic latent image, and are provided in a center area and an edge area of the photoconductor drum 11 extending in the depth direction of FIG. 1.

The developing device 14 stores toner of the color corresponding to the image forming unit 10 (yellow toner in the image forming unit 10Y for yellow), and the electrostatic latent image on the photoconductor drum 11 is developed with the toner. An amount of toner corresponding to the consumed amount is supplied to the developing device 14 as necessary from a toner cartridge 18. The amount of toner supply is determined based on the value detected by an internal concentration sensor 14*a* that detects the toner concentration in the developing device 14 and the number of colored pixels represented by color separation data obtained by separating image data to be printed into the respective colors.

The first transfer roller 15 first-transfers the toner image formed on the photoconductor drum 11 onto the intermediate transfer belt 20. The drum cleaner 16 removes residues (such as toner) on the photoconductor drum 11 after the first transfer.

The intermediate transfer belt 20, which is an endless belt member supported with tension by a drive roller 21, a tension roller 22, and a backup roller 23, circularly moves in the direction of arrow B. Further, a belt cleaner 24 that removes residues (such as toner) on the intermediate transfer belt 20 after the second transfer is disposed upstream of the drive roller 21. Further, image density sensors 31 that measure the densities of toner images on the intermediate transfer belt 20 are disposed at respective positions facing the tension roller 22 across the intermediate transfer belt 20. Measurement values obtained from the measurements by the density sensors 31 are transmitted to the controller 30. In the exemplary embodiment, the intermediate transfer belt 20 corresponds to an example of an image carrier according to an exemplary embodiment of the invention, the image forming units 10 correspond to examples of an image forming unit according to an exemplary embodiment of the invention, and the image density sensors 31 correspond to examples of a measuring unit according to an exemplary embodiment of the invention.

A second transfer roller 51 is disposed at a position facing the backup roller 23 across the intermediate transfer belt 20, and the backup roller 23 and the second transfer roller 51 function as the second transfer device 50.

The printer 1 of the exemplary embodiment includes a sheet transport system 80 that transports the sheet P serving as a recording medium along a transport path R. The sheet P is a so-called continuous sheet. The sheet transport system 80 includes a roll sheet feed-out unit 81 that feeds out the rolled sheet P while unwinding the sheet P and transport rollers 82 that continuously transport a long continuous sheet.

The fixing device 60 including a heating roller 61 and a pressure roller 62 is disposed on the transport path R to cause the image on the sheet P passing through the fixing device 60 to be fixed on the sheet P with heat and pressure. The sheet P after the fixing is sent to a roll sheet wind-up unit (illustration omitted) along the transport path R.

An inline sensor 32 that measures the density of the image on the sheet P is provided downstream of the fixing device 60 on the transport path R. A measurement value obtained from the measurement by the inline sensor 32 is transmitted to the controller 30.

A basic image forming process of the printer 1 will now be described.

If image data is transmitted to the printer 1 from an external apparatus such as a personal computer (PC), for example, the controller 30 receives the image data and performs tone curve correction processing, screen processing, and so forth on the image data of the four colors (the Y, M, C, and K colors) to generate image signals of the respective colors. The controller 30 then inputs the image signal of the corresponding color to the exposure device 13 in each of the image forming units 10 (specifically, 10Y, 10M, 10C, and 10K), and an electrostatic latent image is formed on the photoconductor drum 11. Then, the toner images of the respective colors are formed on the photoconductor drums 11 through the development and sequentially first-transferred onto a surface of the intermediate transfer belt 20 with the first transfer rollers 15, thereby forming a color toner image.

With the rotation of the intermediate transfer belt 20, the color toner image on the intermediate transfer belt 20 is transported to a second transfer position and superimposed on the sheet P transported by the sheet transport system 80. The toner image thus superimposed on the sheet P is transferred to the sheet P by the action of a transfer electric field in the second transfer device 50.

The sheet P having the toner image transferred thereto is transported to the fixing device 60 to fix the toner image on the sheet P in the fixing device 60, and thereafter is wound up in a roll.

In addition to a so-called job operation of forming the image represented by the image data transmitted from the external apparatus, the printer 1 illustrated in FIG. 1 also performs an adjustment operation of adjusting the output density of the printer 1. The adjustment operation is realized under control by the controller 30, and the controller 30 that controls the adjustment operation corresponds to a density adjusting device according to an exemplary embodiment of the invention.

Details of the adjustment operation will be described below.

Figure 2:
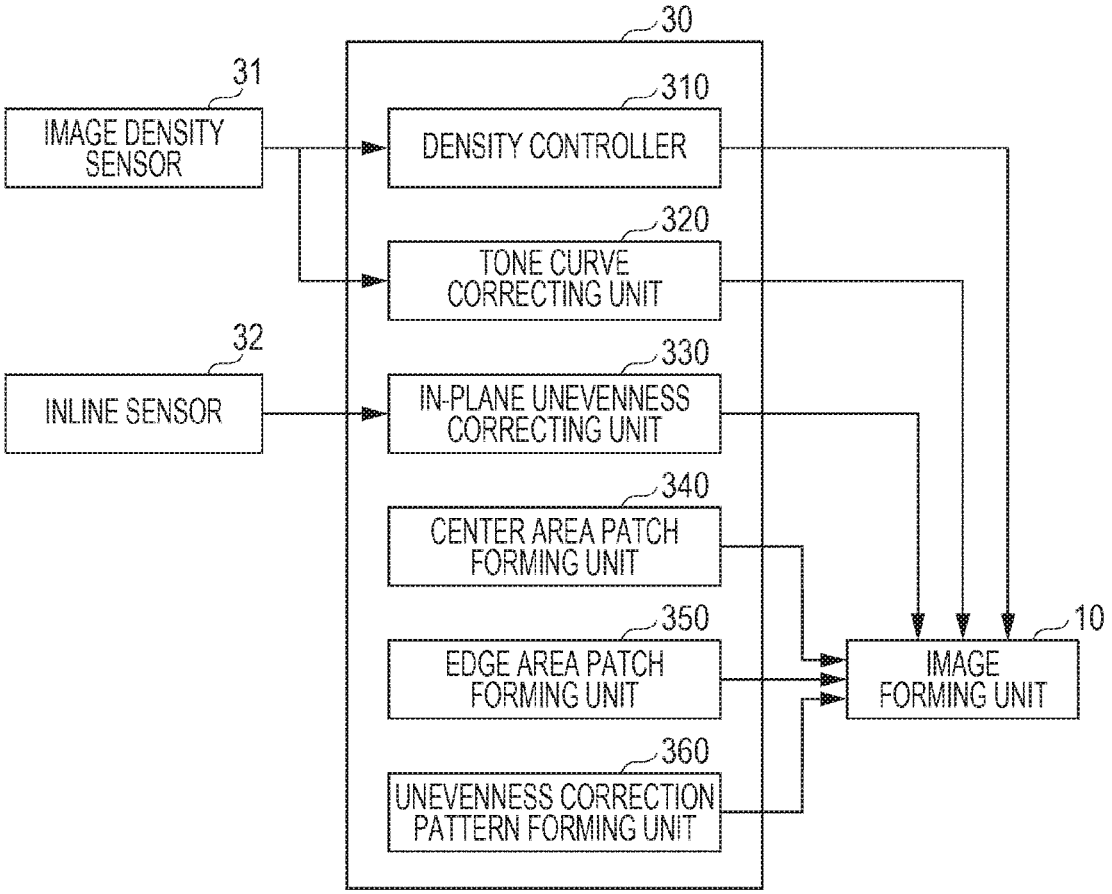
FIG. 2 is a functional configuration diagram illustrating functions of a controller that execute an adjustment operation.

FIG. 2 is a functional configuration diagram illustrating functions of the controller 30 that execute the adjustment operation.

The controller 30 includes, as functional elements thereof, a density controller 310, a tone curve correcting unit 320, an in-plane unevenness correcting unit 330, a center area patch forming unit 340, an edge area patch forming unit 350, and an unevenness correction pattern forming unit 360. The density controller 310 and the tone curve correcting unit 320 correspond to an example combining a first adjusting unit and a second adjusting unit according to an exemplary embodiment of the invention, and the in-plane unevenness correcting unit 330 corresponds to an example of a third adjusting unit according to an exemplary embodiment of the invention. Further, the center area patch forming unit 340 corresponds to an example of a first formation controller according to an exemplary embodiment of the invention, and the edge area patch forming unit 350 corresponds to an example of a second formation controller according to an exemplary embodiment of the invention.

The controller 30 is a board computer including a central processing unit (CPU) and so forth as hardware, and a density adjusting program according to an exemplary embodiment of the invention is incorporated into the hardware of the controller 30 as software. Further, the density adjusting program according to an exemplary embodiment is executed by the controller 30 to thereby execute a density adjusting method according to an exemplary embodiment of the invention, and the controller 30 functions as the density adjusting device according to an exemplary embodiment of the invention. The functional configuration illustrated in FIG. 2 also illustrates the configuration of the density adjusting program according to an exemplary embodiment.

Under control by the center area patch forming unit 340 and the edge area patch forming unit 350, the image forming units 10 form later-described patch images as an example of color samples according to an exemplary embodiment of the invention, and the image density sensors 31 measure the densities of the patch images. Further, under control by the unevenness correction pattern forming unit 360, the image forming units 10 form a later-described pattern image for correcting in-plane unevenness, and the inline sensor 32 measures the densities of the pattern image. The values measured by the image density sensors 31 are read by the density controller 310 and the tone curve correcting unit 320 and used in later-described density control and tone curve correction. Further, the values measured by the inline sensor 32 are read by the in-plane unevenness correcting unit 330 and used in later-described in-plane unevenness correction.

The adjustment operation performed in the exemplary embodiment is roughly divided into so-called setup executed before the start of the job and in-job adjustment executed in parallel with image printing during the job. The setup and the in-job adjustment will be described in detail below.

Figure 3:
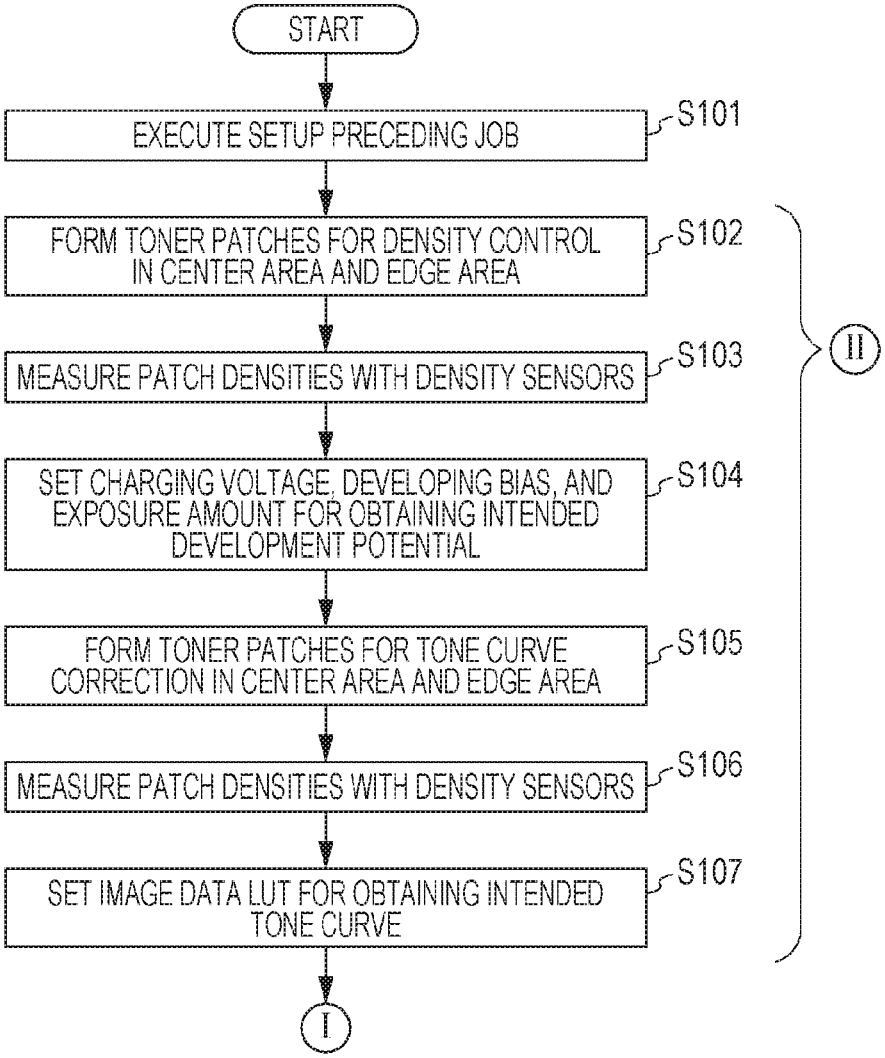
FIG. 3 is a flowchart illustrating an initial stage of a setup operation.
Figure 4:
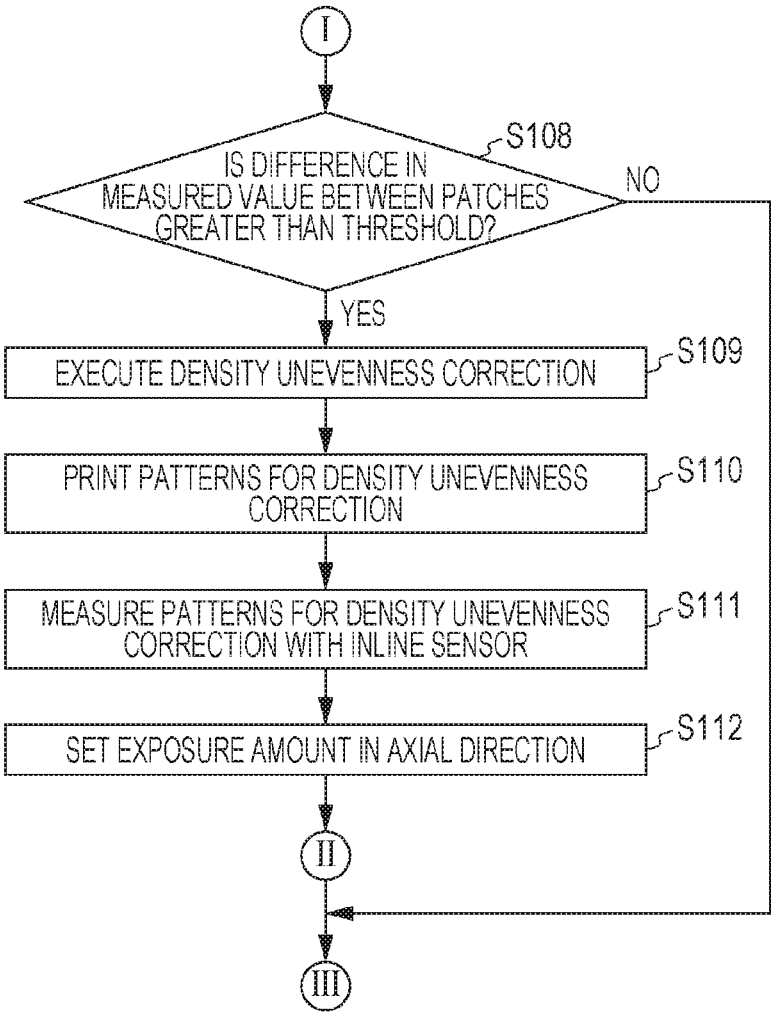
FIG. 4 is a flowchart illustrating a middle stage of the setup operation.
Figure 5:
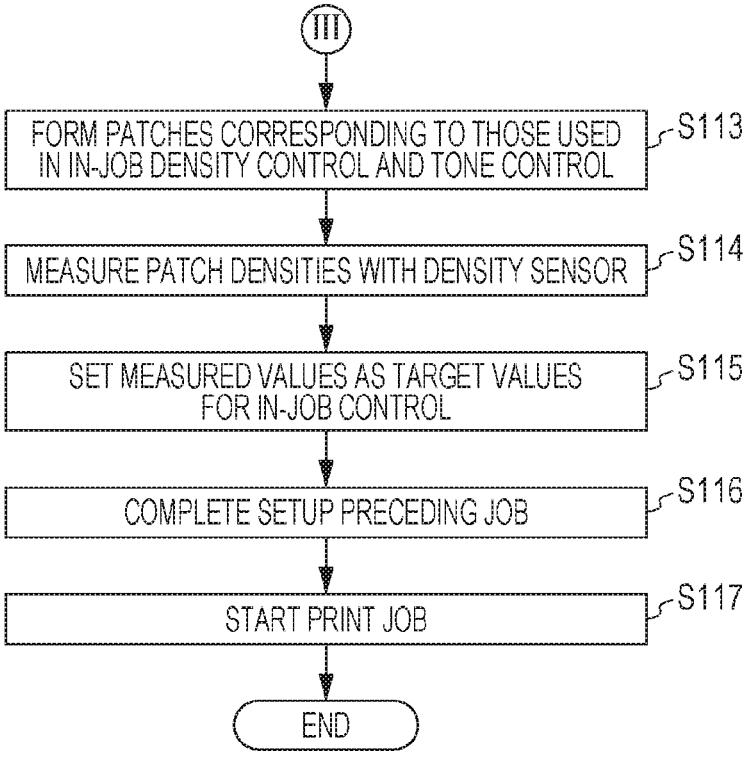
FIG. 5 is a flowchart illustrating a final stage of the setup operation.

FIGS. 3 to 5 are flowcharts illustrating the operation of setup.

The flow of processing connects from I of FIG. 3 to I of FIG. 4, and from III of FIG. 4 to III of FIG. 5.

When the process illustrated in FIG. 3 starts, the need for the setup preceding the job is checked at step S101. If the setup preceding the job is necessary, the procedure proceeds to step S102. The setup is necessary immediately after power-on, and thereafter whether or not the setup is necessary is determined in the later-described in-job adjustment.

At step S102, under control by the center area patch forming unit 340 and the edge area patch forming unit 350 illustrated in FIG. 2, toner patches for density control are formed in a center area and an edge area of the intermediate transfer belt 20.

Figure 6:
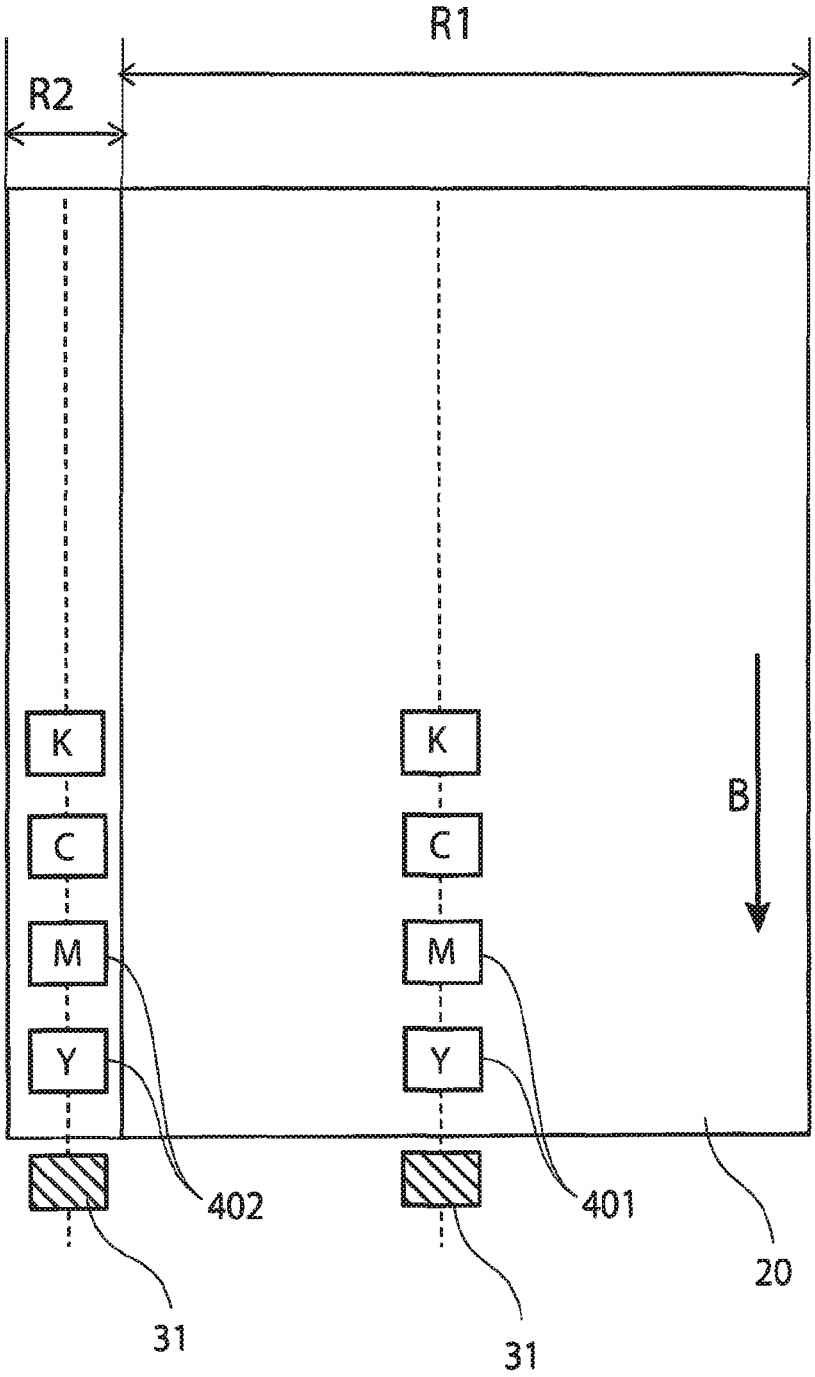
FIG. 6 is a diagram illustrating an example of toner patches for density control.

FIG. 6 is a diagram illustrating an example of the toner patches for density control.

FIG. 6 illustrates the intermediate transfer belt 20 illustrated in FIG. 1, as viewed from above in FIG. 1 (that is, from the side of the image forming units 10). The intermediate transfer belt 20 moves in the direction indicated by arrow B in the drawing. The drawing further illustrates, in the width direction perpendicular to the moving direction of the intermediate transfer belt 20, a range in which the image is transferred onto the sheet P (a transfer area R1) and a range in which the image is not transferred onto the sheet P (a non-transfer area R2). Further, center area patches 401 for density control are formed in a center area of the transfer area R1 under control by the center area patch forming unit 340, and edge area patches 402 for density control are formed in the non-transfer area R2 located in an edge area of the intermediate transfer belt 20 under control by the edge area patch forming unit 350. The center area patches 401 and the edge area patches 402 formed in the exemplary embodiment are toner patches of the K, C, M, and Y colors each having 80% of image coverage, for example.

As the above-described image density sensors 31, two image density sensors 31 are provided to face the intermediate transfer belt 20 on respective lines formed with the center area patches 401 and the edge area patches 402. After the center area patches 401 and the edge area patches 402 as illustrated in FIG. 6 are formed at step S102 in FIG. 3, the respective image density sensors 31 illustrated in FIG. 6 then measure the densities of the center area patches 401 and the edge area patches 402 at step S103.

The measurement values of the image density sensors 31 are read by the density controller 310 illustrated in FIG. 2. At step S104 in FIG. 3, the density controller 310 sets a charging voltage, a developing bias, and the exposure amount (the intensity of exposure light) of the charger 12, the developing device 14, and the exposure device 13, respectively, illustrated in FIG. 1, to obtain the intended development potential. It is assumed that the measured densities of the center area patches 401 are mostly used in the setting of the charging voltage and so forth, and that the measured densities of the edge area patches 402 are used in comparison with the measured densities of the center area patches 401.

Then, at step S105 in FIG. 3, toner patches for tone curve correction are formed in the center area and the edge area of the intermediate transfer belt 20 under control by the center area patch forming unit 340 and the edge area patch forming unit 350 illustrated in FIG. 2.

Figure 7:
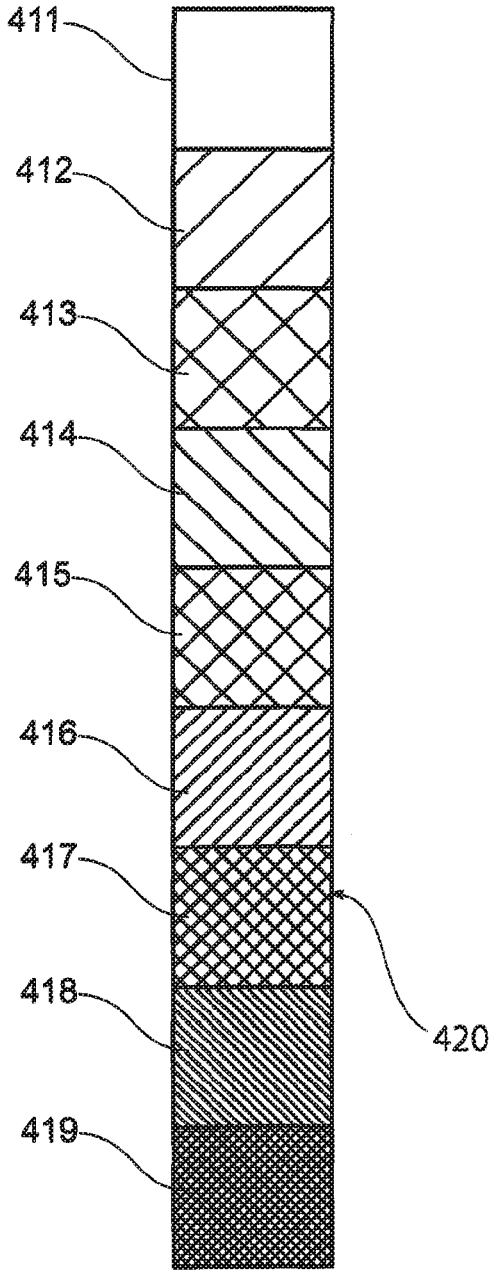
FIG. 7 is a diagram illustrating an example of toner patches for tone curve correction.

FIG. 7 is a diagram illustrating an example of the toner patches for tone curve correction.

In the exemplary embodiment, under control by the center area patch forming unit 340 and the edge area patch forming unit 350 illustrated in FIG. 2, a tone patch image 420 is formed which includes, as the toner patches for tone curve correction, nine patches 411 to 419 in total having 0%, 5%, 10%, 20%, 30%, 40%, 60%, 80%, and 100% of image coverage, respectively, for example. The tone patch image 420 is formed in both the center area of the transfer area R1 and the non-transfer area R2 illustrated in FIG. 6.

After such a tone patch image 420 is formed as the toner patches for tone curve correction at step S105 in FIG. 3, each of the image density sensors 31 illustrated in FIG. 6 then measures the densities of the patches 411 to 419 included in the tone patch image 420 at step S106.

The measured density values of the patches 411 to 419 are read by the tone curve correcting unit 320 illustrated in FIG. 2, and the tone curve correcting unit 320 sets image data look up table (LUT) at step S107 in FIG. 3 to obtain the intended tone curve. The image data LUT is a table including inputs of image data input from an external apparatus or the like, with the values of the inputs associated with respective output values. The input image data is converted in accordance with the image data LUT, to thereby convert the tone curve of the image into the intended tone curve.

It is assumed that the measured densities of the tone patch image 420 formed in the center area of the transfer area R1 are mostly used in the setting of the image data LUT by the tone curve correcting unit 320, and that the measured densities of the tone patch image 420 formed in the non-transfer area R2 are used in comparison with the measured densities of the tone patch image 420 in transfer area R1.

The above-described processes of steps S102 to S107 in FIG. 3 will occasionally be referred to as process II in the following.

After the completion of process II in FIG. 3, the procedure of the processing shifts to the procedure illustrated in the flowchart of FIG. 4. At step S108, it is determined whether or not the difference in the measured value between the tone patch image 420 in the transfer area R1 and the tone patch image 420 in the non-transfer area R2 is greater than a predetermined threshold (that is, exceeds the threshold). Then, if the difference in the measured value is greater than the threshold, it is determined to execute in-plane unevenness correction of correcting density unevenness occurring in an image plane (in-plane unevenness) (step S109). The comparison at step S108 is for checking the presence or absence of the in-plane unevenness, and thus does not necessarily require the use of the measured values of the tone patch images 420. For example, the potential of the electrostatic latent image in the edge area and the potential of the electrostatic latent image in the center area may be measured with the potential sensors 17 illustrated in FIG. 1 and compared to each other to check the presence or absence of the in-plane unevenness.

If it is determined to execute the in-plane unevenness correction as a result of the comparison at step S108 (step S109), a pattern image for in-plane unevenness correction is formed at step S110 under control by the unevenness correction pattern forming unit 360 illustrated in FIG. 2.

Figure 8:
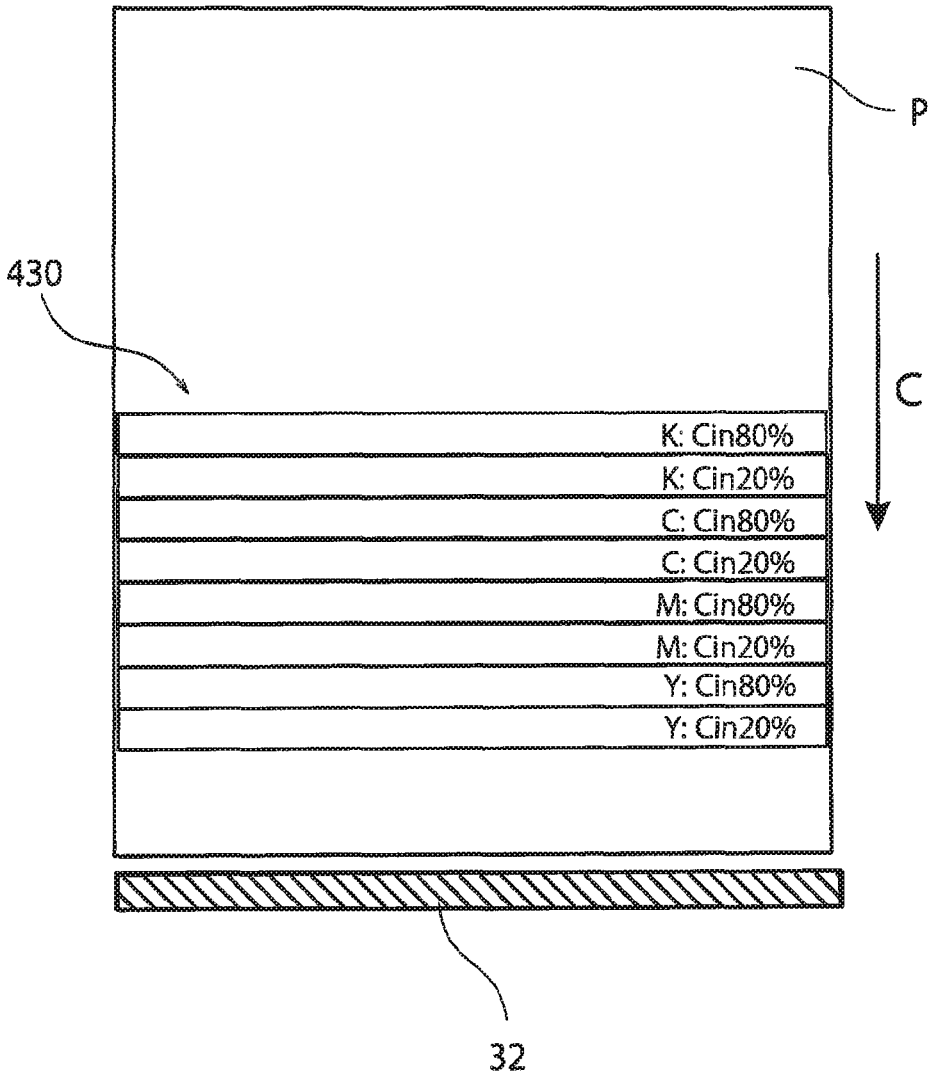
FIG. 8 is a diagram illustrating a pattern image for in-plane unevenness correction.

FIG. 8 is a diagram illustrating the pattern image for in-plane unevenness correction.

FIG. 8 illustrates a part of the long sheet P, with the sheet P viewed from above in FIG. 1 (that is, from the side of the intermediate transfer belt 20). The sheet P is transported in the direction of arrow C illustrated in the drawing.

A pattern image 430 for in-plane unevenness correction is an image transferred onto and fixed on the sheet P. In the exemplary embodiment, patterns respectively having 80% and 20% of image coverage, for example, are formed for each of the K, C, M, and Y colors in the pattern image 430. The pattern image 430 for in-plane unevenness correction includes bar-shaped patterns extending to the full width of the sheet P in the sheet width direction perpendicular to the transport direction indicated by arrow C.

With the transport of the sheet P, the pattern image 430 for in-plane unevenness correction passes a position facing the inline sensor 32, which is also illustrated in FIG. 1. Then, at step S111 in FIG. 4, the inline sensor 32 measures the densities of the pattern image 430 for in-plane unevenness correction at respective positions in the sheet width direction. The thus-measured densities represent density unevenness occurring in the plane of the sheet P (mostly in the sheet width direction thereof).

Figure 9:
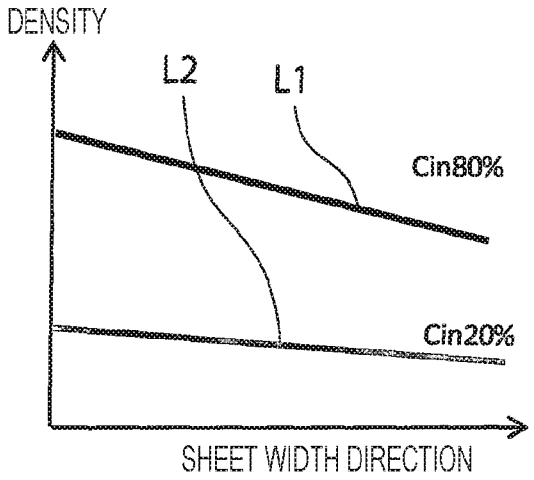
FIG. 9 is a diagram illustrating an example of measured densities of the pattern image.

FIG. 9 is a diagram illustrating an example of the measured densities of the pattern image 430.

In the graph of FIG. 9, the horizontal axis represents the position in the sheet width direction of the sheet P, and the vertical axis represents the density of the pattern image 430. FIG. 9 further illustrates a line L1 representing the measured density of a pattern having 80% of image coverage and a line L2 representing the measured density of a pattern having 20% of image coverage. Each of these lines L1 and L2 has a slope corresponding to unevenness in image density in the sheet width direction. In the example illustrated here, the density decreases downward to the right. Further, the respective slopes of the lines L1 and L2 do not match in general.

To correct such in-plane unevenness, at step S112 in FIG. 4, the in-plane unevenness correcting unit 330 illustrated in FIG. 2 sets the exposure amount of the exposure device 13 illustrated in FIG. 1 to be different in a first scanning direction along the axis of the photoconductor drum 11 corresponding to the sheet width direction.

Figure 10:
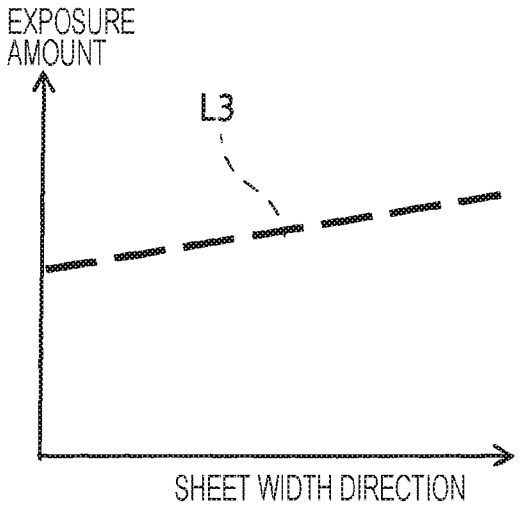
FIG. 10 is a diagram illustrating an example of an exposure amount set by an in-plane unevenness correcting unit.

FIG. 10 is a diagram illustrating an example of the exposure amount set by the in-plane unevenness correcting unit 330.

In the graph of FIG. 10, the horizontal axis represents the position in the first scanning direction corresponding to the sheet width direction of the sheet P, and the vertical axis represents the exposure amount. FIG. 10 further illustrates a line L3 representing the setting of the exposure amount according to the position.

In the example illustrated here, the exposure amount is set to increase upward to the right to cancel the unevenness in image density represented by the right downward lines L1 and L2 illustrated in FIG. 9. Further, the line L3 representing the setting of exposure amount has a slope balancing with different slopes of the two lines L1 and L2 illustrated in FIG. 9 to suppress both the unevenness in image density represented by the line L1 and the unevenness in image density represented by the line L2.

Figure 11:
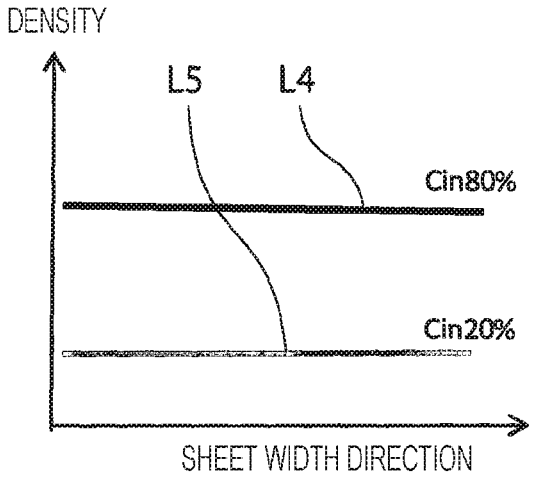
FIG. 11 is a diagram illustrating a state in which in-plane unevenness is corrected.

FIG. 11 is a diagram illustrating a state in which the in-plane unevenness is corrected.

In the graph of FIG. 11, the horizontal axis represents the position in the sheet width direction of the sheet P, and the vertical axis represents the image density. FIG. 11 further illustrates lines L4 and L5 representing density distributions as a result of correction of the unevenness in image density represented by the two lines L1 and L2 illustrated in FIG. 9.

As a result of setting the exposure amount as illustrated in FIG. 10 against the unevenness in image density illustrated in FIG. 9, a substantially constant density is obtained relative to the position in the sheet width direction in both the density distribution of the pattern having 80% of image coverage and the density distribution of the pattern having 20% of image coverage, as indicated by the lines L4 and L5, respectively.

With the setting of the exposure amount at step S112 in FIG. 4, the constant image density as described above is realized in the plane. Thereafter, the above-described process II is executed again, and the procedure shifts to the procedure illustrated in the flowchart of FIG. 5. At step S113, patches similar to those used in the in-job adjustment are formed in the non-transfer area R2 illustrated in FIG. 6. In the exemplary embodiment, the density control and the tone curve correction are both executed in the in-job adjustment. The patches used in the density control and the tone curve correction are the same as the edge area patches 402 illustrated in FIG. 6 and the patches of the tone patch image 420 illustrated in FIG. 7.

The densities of the edge area patches 402 and the patches of the tone patch image 420 thus formed are measured by the image density sensor 31 (step S114), and the measurement values obtained from the measurements are set as target values in the in-job adjustment (the target values of the density and the target values of the tone curve) (step S115).

Thereafter, the setup preceding the job is completed (step S116), and the print job starts (step S117).

Since the above-described setup is executed before the job and consumes sheets, the frequency of execution of the setup is desired to be reduced as much as possible from the perspective of productivity. In the exemplary embodiment, therefore, the in-job adjustment described below is executed. Since the in-job adjustment is executed in parallel to image formation in the job and does not consume sheets, the influence thereof on the productivity is small.

Figure 12:
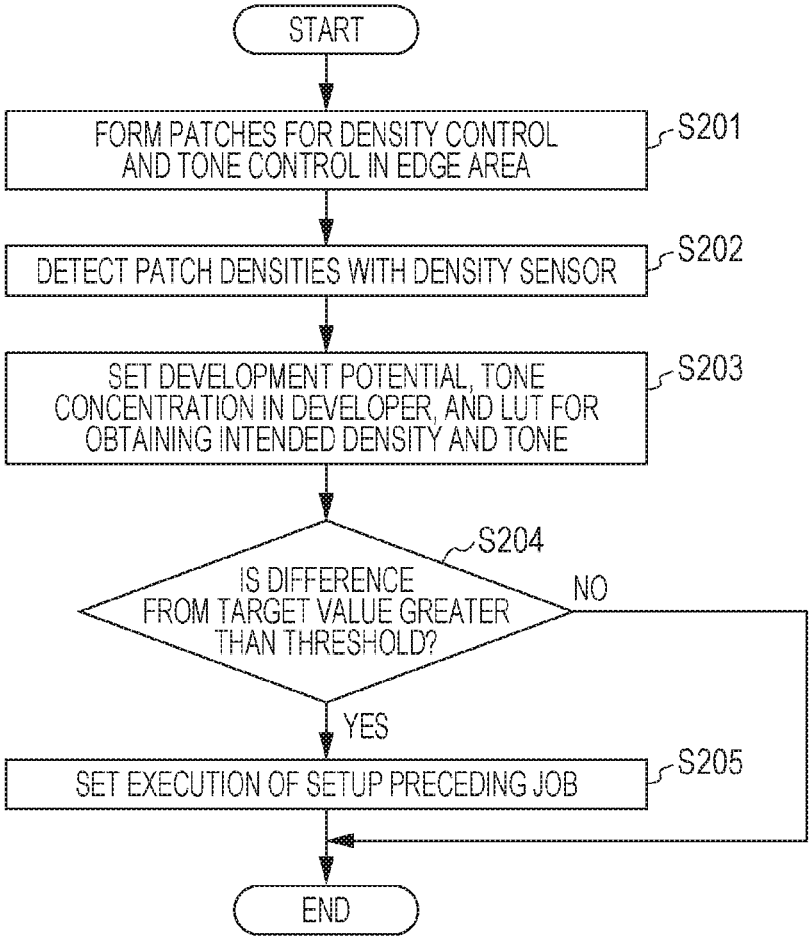
FIG. 12 is a flowchart illustrating an operation of in-job adjustment.

FIG. 12 is a flowchart illustrating the operation of in-job adjustment.

When the in-job adjustment starts, patches similar to the edge area patches 402 illustrated in FIG. 6 and the patches of the tone patch image 420 illustrated in FIG. 7 are formed in the non-transfer area R2 illustrated in FIG. 6 (step S201), and the densities of the patches are measured by the corresponding image density sensor 31 (step S202). Then, the density control and the tone curve correction are performed to obtain the target values of the density and the target values of the tone curve set at step S115 in FIG. 5 (step S203). Herein, in the tone curve correction, the image data LUT is set similarly as in the tone curve correction performed in the setup. Meanwhile, in the density control, the development potential and the toner concentration in the developing device 14 are adjusted to reduce the difference between each of the measured densities of the edge area patches 402 and the corresponding target value, unlike in the density control in the setup.

Figure 13:
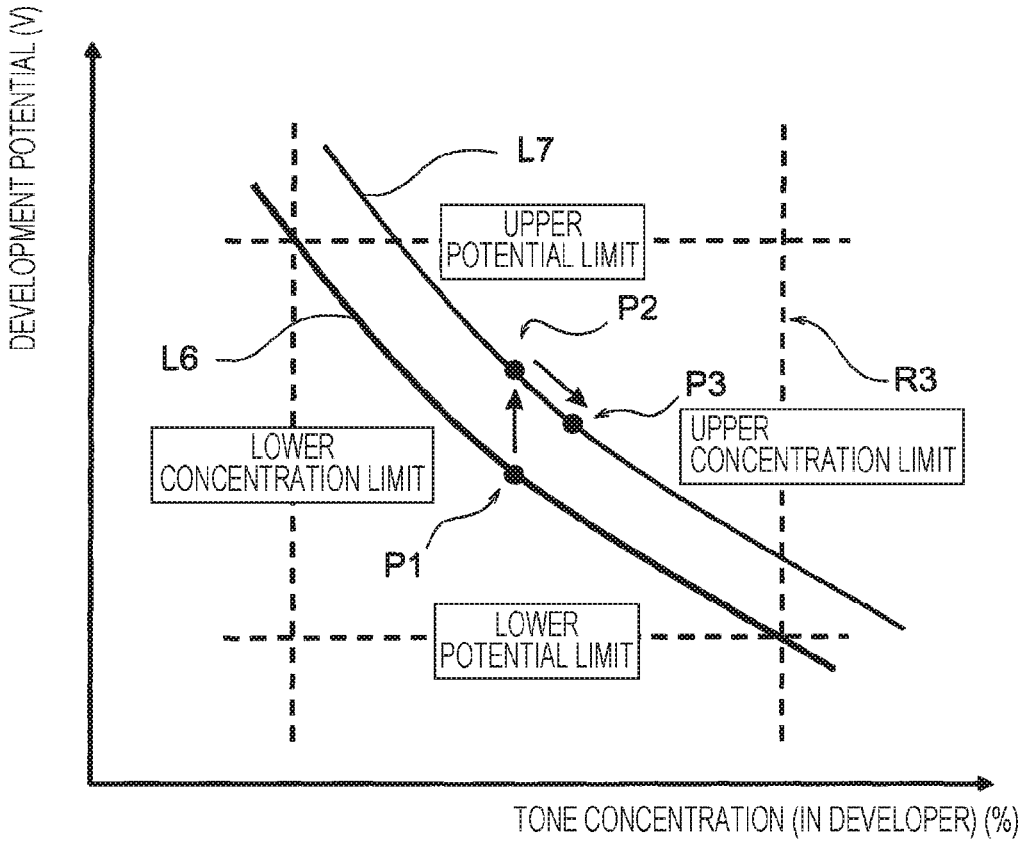
FIG. 13 is a diagram illustrating density control in the in-job adjustment.

FIG. 13 is a diagram illustrating the density control in the in-job adjustment.

In the graph of FIG. 13, the horizontal axis represents the toner concentration in the developing device 14, and the vertical axis represents the development potential.

FIG. 13 illustrates an adjustment range R3 enclosed by the respective upper and lower limits of the concentration and potential adjustable without causing an image defect. In the in-job adjustment, the concentration and potential are adjusted in the adjustment range R3. FIG. 13 further illustrates a line L6 on which the target image density is realized. The target image density is obtained by adjustment to the concentration and potential indicated by a point located on the line L6.

It is assumed that, in the setup, a state in which the line L6 substantially diagonally crosses the adjustment range R3 is obtained through adjustment of image forming conditions other than the toner concentration in the developing device 14 and the development potential, with the concentration and potential adjusted to the ones indicated by a point P1 located substantially in the center of the adjustment range R3.

The line for realizing the target image density shifts depending on an environmental change or a change over time after the setup. For example, if development performance deteriorates owing to an environmental change or the like, the line for realizing the target image density changes to a line L7, which is above the line L6 for the setup in the graph. If the line for realizing the target image density thus shifts, the development potential is first adjusted in the in-job adjustment to cause a shift from the point P1 for the setup to an upper point P2. Thereafter, adjustment is performed to balance the concentration and the potential, and the point P2 shifts to a point P3 along the line L7.

In the in-job adjustment, the concentration and potential are thus adjusted to respond to the environmental change or the change over time. Further, the target image density is obtained through the in-job adjustment, as long as the line L6 or L7 for realizing the target image density passes through the adjustment range R3.

If the line for realizing the target image density deviates from the adjustment range R3 owing to an increase in the environmental change or the change over time, however, the target image density is not obtained by the adjustment in the adjustment range R3, and a difference arises between the measured density of the patch and the target density. Further, the in-job adjustment is performed only with the patches formed in the non-transfer area R2 illustrated in FIG. 6, and thus the occurrence of in-plane unevenness is not directly confirmable. If the in-plane unevenness increases, however, the line for realizing the target image density is expected to move and deviate from the adjustment range R3 also in this case, causing a difference between the measured density of the patch and the target density. Conversely speaking, if the line for realizing the target image density passes though the adjustment range R3, it is inferred that no serious in-plane unevenness has occurred, and the target density is accurately reproduced through the repetition of the in-job adjustment.

At step S204 in FIG. 12, if the difference between the measured density of the patch and the target density is confirmed, and if the difference in density exceeds a threshold (YES at step S204), it is determined that the control by the in-job adjustment has reached the limit thereof, and the procedure proceeds to step S205 to set the execution of the setup. If the execution of the setup is thus set, the need for the setup is checked at step S101 in FIG. 3 when the next job starts, and the setup is executed.

In the setup, the presence or absence of the in-plane unevenness is checked at step S108 in FIG. 4, as described above. If the in-plane unevenness has occurred, the in-plane unevenness correction is executed. Consequently, the reproduction accuracy of the target density is restored by the in-job adjustment, and the in-job adjustment is repeated again.

In the foregoing description, the execution of the setup is set in the in-job adjustment with a focus placed on the relationship between the in-plane unevenness correction and the density control. There is a similar relationship between the in-plane unevenness correction and the tone curve correction. At step S204 in FIG. 12, therefore, the difference between the measured value of the tone patch image 420 and the target tone is also checked, and if the difference exceeds the threshold (YES at step S204), the execution of the setup is set (step S205).

Further, in the foregoing exemplary embodiment, a color printer has been described as an example of an image forming apparatus according to an exemplary embodiment of the invention. The image forming apparatus according to an exemplary embodiment of the invention, however, may be applied to a copier, a facsimile machine, a multifunction machine, or the like, and may be applied to a dedicated monochrome machine.

Further, in the foregoing exemplary embodiment, an apparatus that forms an image with a so-called electrophotographic system has been described as an example. The image forming apparatus according to an exemplary embodiment of the invention, however, may be applied to an apparatus that forms an image with an inkjet system or a thermal transfer system, for example.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries an image formed on a surface thereof;

an image forming unit that forms the image on the image carrier;

a transfer unit that transfers the image on the image carrier onto a recording medium;

a density measuring unit that measures a density of the image on the image carrier; and a density adjusting unit that adjusts an output density of the image forming unit, and executes first formation control of forming a first color sample in a transfer area of an area on the image carrier, in which the carried image is transferred onto the recording medium, first adjustment of adjusting output characteristics of the image forming unit to reduce a difference between a measured density of the first color sample measured by the density measuring unit and a predetermined first target density, second formation control of forming a second color sample in a non-transfer area of the area on the image carrier excluding the transfer area, second adjustment of adjusting the output characteristics of the image forming unit to reduce a difference between a measured density of the second color sample measured by the density measuring unit and a predetermined second target density, and third adjustment of adjusting the output characteristics of the image forming unit to reduce a difference in the output density between the transfer area and the non-transfer area, if the difference between the measured density of the second color sample and the second target density exceeds a predetermined extent as a result of repeating the second formation control and the second adjustment.

2. The image forming apparatus according to claim 1, wherein a density of the second color sample obtained after the first adjustment is used as the second target density.

3. The image forming apparatus according to claim 1, wherein a density of the second color sample obtained after the first adjustment following the third adjustment is used as the second target density.

4. The image forming apparatus according to claim 1, wherein, in the third adjustment, if the difference between the measured density of the second color sample and the second target density exceeds the predetermined extent, the difference in the output density between the transfer area and the non-transfer area is calculated, and if the difference in the output density exceeds a predetermined extent, the output characteristics of the image forming unit are adjusted to reduce the difference in the output density.

5. The image forming apparatus according to claim 2, wherein, in the third adjustment, if the difference between the measured density of the second color sample and the second target density exceeds the predetermined extent, the difference in the output density between the transfer area and the non-transfer area is calculated, and if the difference in the output density exceeds a predetermined extent, the output characteristics of the image forming unit are adjusted to reduce the difference in the output density.

6. The image forming apparatus according to claim 3, wherein, in the third adjustment, if the difference between the measured density of the second color sample and the second target density exceeds the predetermined extent, the difference in the output density between the transfer area and the non-transfer area is calculated, and if the difference in the output density exceeds a predetermined extent, the output characteristics of the image forming unit are adjusted to reduce the difference in the output density.

7. A density adjusting device for an image forming apparatus that forms an image on a surface of an image carrier to carry the image on the image carrier, transfers the formed image onto a recording medium, and is capable of measuring a density of the image on the image carrier, the density adjusting device comprising:

a first formation controller that forms a first color sample in a transfer area of an area on the image carrier, in which the carried image is transferred onto the recording medium;

a first adjusting unit that adjusts output characteristics of the image forming apparatus to reduce a difference between a measured density of the first color sample and a predetermined first target density;

a second formation controller that forms a second color sample in a non-transfer area of the area on the image carrier excluding the transfer area;

a second adjusting unit that adjusts the output characteristics of the image forming apparatus to reduce a difference between a measured density of the second color sample and a predetermined second target density; and a third adjusting unit that adjusts the output characteristics of the image forming apparatus to reduce a difference in output density between the transfer area and the non-transfer area, if the difference between the measured density of the second color sample and the second target density exceeds a predetermined extent as a result of repeating operations of the second formation controller and the second adjusting unit.

8. A non-transitory computer readable medium storing a program causing an image forming apparatus, which forms an image on a surface of an image carrier to carry the image on the image carrier, transfers the formed image onto a recording medium, and is capable of measuring a density of the image on the image carrier, to execute a process for density adjustment, the process comprising:

executing first formation control of forming a first color sample in a transfer area of an area on the image carrier, in which the carried image is transferred onto the recording medium;

executing first adjustment of adjusting output characteristics of the image forming apparatus to reduce a difference between a measured density of the first color sample and a predetermined first target density;

executing second formation control of forming a second color sample in a non-transfer area of the area on the image carrier excluding the transfer area;

executing second adjustment of adjusting the output characteristics of the image forming apparatus to reduce a difference between a measured density of the second color sample and a predetermined second target density; and executing third adjustment of adjusting the output characteristics of the image forming apparatus to reduce a difference in output density between the transfer area and the non-transfer area, if the difference between the measured density of the second color sample and the second target density exceeds a predetermined extent as a result of repeating the second formation control and the second adjustment.

9. A density adjusting method of causing an image forming apparatus, which forms an image on a surface of an image carrier to carry the image on the image carrier, transfers the formed image onto a recording medium, and is capable of measuring a density of the image on the image carrier, to:

execute first formation control of forming a first color sample in a transfer area of an area on the image carrier, in which the carried image is transferred onto the recording medium, execute first adjustment of adjusting output characteristics of the image forming apparatus to reduce a difference between a measured density of the first color sample and a predetermined first target density;

execute second formation control of forming a second color sample in a non-transfer area of the area on the image carrier excluding the transfer area;

execute second adjustment of adjusting the output characteristics of the image forming apparatus to reduce a difference between a measured density of the second color sample and a predetermined second target density; and execute third adjustment of adjusting the output characteristics of the image forming apparatus to reduce a difference in output density between the transfer area and the non-transfer area, if the difference between the measured density of the second color sample and the second target density exceeds a predetermined extent as a result of repeating the second formation control and the second adjustment.

10. An image forming method comprising:

forming an image on a surface of an image carrier with an image forming unit;

carrying the image on the image carrier;

measuring a density of the image on the image carrier;

adjusting an output density of the image forming unit, the adjusting including executing first formation control of forming a first color sample in a transfer area of an area on the image carrier, in which the carried image is transferred onto a recording medium, executing first adjustment of adjusting output characteristics of the image forming unit to reduce a difference between a measured density of the first color sample and a predetermined first target density, executing second formation control of forming a second color sample in a non-transfer area of the area on the image carrier excluding the transfer area, executing second adjustment of adjusting the output characteristics of the image forming unit to reduce a difference between a measured density of the second color sample and a predetermined second target density, and executing third adjustment of adjusting the output characteristics of the image forming unit to reduce a difference in the output density between the transfer area and the non-transfer area, if the difference between the measured density of the second color sample and the second target density exceeds a predetermined extent as a result of repeating the second formation control and the second adjustment; and transferring the image on the image carrier onto the recording medium.

* * * * *